US007162185B2

(12) United States Patent
Ehara

(10) Patent No.: US 7,162,185 B2
(45) Date of Patent: Jan. 9, 2007

(54) TRANSMISSION FOR IMAGE FORMATION APPARATUS, METHOD OF MANUFACTURING THE TRANSMISSION, AND IMAGE FORMATION APPARATUS

(75) Inventor: Yasuhisa Ehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 560 days.

(21) Appl. No.: 10/660,537

(22) Filed: Sep. 12, 2003

(65) Prior Publication Data

US 2004/0126137 A1 Jul. 1, 2004

(30) Foreign Application Priority Data

Sep. 13, 2002 (JP) ..... 2002-268922

(51) Int. Cl.
*G03G 15/00* (2006.01)

(52) U.S. Cl. ..... 399/167; 399/117

(58) Field of Classification Search ..... 399/117, 399/167, 301, 263, 107, 75, 116; 74/10.8, 74/10.85; 464/182, 106; 403/13, 69, 199
See application file for complete search history.

(56) References Cited

U.S. PATENT DOCUMENTS

| | | | | |
|---|---|---|---|---|
| 2,473,417 | A * | 6/1949 | Essl | 74/568 R |
| 3,985,432 | A * | 10/1976 | Hou et al. | 399/135 |
| 5,210,574 | A * | 5/1993 | Kita | 399/117 |
| 6,661,986 | B1 * | 12/2003 | Kitayama | 399/167 |
| 6,907,205 | B1 * | 6/2005 | Himes et al. | 399/90 |

FOREIGN PATENT DOCUMENTS

| | | |
|---|---|---|
| JP | 7-239596 | 9/1995 |

* cited by examiner

*Primary Examiner*—David M. Gray
*Assistant Examiner*—David A. Blackshire
(74) *Attorney, Agent, or Firm*—Oblon, Spivak, McClelland, Maier & Neustadt, P.C.

(57) ABSTRACT

A transmission comprises a rotary shaft; a gear secured to the rotary shaft coaxially; and a regulative member secured to the rotary shaft. This regulative member press-contacts one end of the gear to maintain the gear exactly perpendicular to an axis of the rotary shaft. A photosensitive drum is fit to the gear. The regulative member is secured on the rotary shaft by press fitting.

35 Claims, 7 Drawing Sheets

TRANSMISSION FOR IMAGE FORMATION APPARATUS, METHOD OF MANUFACTURING THE TRANSMISSION, AND IMAGE FORMATION APPARATUS

BACKGROUND OF THE INVENTION

1) Field of the Invention

The present invention relates to a transmission having a transmissive member fixedly fitted with a rotary shaft, an image formation apparatus including the transmission, and a transmission manufacturing method.

2) Description of the Related Art

Transmissions are employed widely in various machines. For example, a transmission is used in image formation apparatuses to rotate a transmissive member. The rotational force is transmitted, via a rotary shaft, to a photosensitive drum that carries a toner image. The transmissive member includes gears and pulleys. Such a technology has been disclosed in, for example, Japanese Patent Application Laid-open Publication No. H7-239596 on pages 7 and 8, and in FIG. 6.

However, if the transmissive member makes an angle with the rotary shaft, there occurs variation in the speed of the rotations transmitted. This problem will be explained in detail taking the above-mentioned publication as an example. This publication discloses to fit the photosensitive drum to the rotary shaft, fit the transmissive member to the rotary shaft, and drive the rotary member by a motor. The transmissive member includes gears and shafts. The rotation axes of the gears are perpendicular to the rotary shaft. However, if the rotation axes of the gears are not perfectly perpendicular to the rotary shaft, even if the gears are rotated at constant speed, the rotations are not properly conveyed to the rotary shaft, and hence the photosensitive drum does not rotate at desired speed. As a result, a desired toner image can not be formed on the photosensitive drum and the image quality degrades.

One approach to solve the above mentioned problem is to provide a member (hereafter, "regulative member") that regulates the angle of the gears of the transmissive member. This regulative member is, for example, fixed to the rotary shaft and pressed against the gears of the transmissive member in such a manner that the rotation axes of the gears are perfectly perpendicular to the rotary shaft. The regulative member is fit to the rotary shaft with a screw. However, when the screw is fastened, the fastening force imposes a large stress on the regulative member and deforms the regulative member. This deteriorates the state of perfect perpendicularity of the rotation axes of the gears with the rotary shaft.

SUMMARY OF THE INVENTION

It is an object of the present invention to solve at least the problems in the conventional technology.

A transmission according to one aspect of the present invention includes a rotary shaft; a transmissive member coupled with the rotary shaft and secured to the rotary shaft, the transmissive member having a first end and a second end; and a regulative member secured to the rotary shaft by press fitting and press-contacts the first end of the transmissive member in such a manner that the transmissive member is perpendicular to the rotary shaft.

An image formation apparatus according to another aspect of the present invention includes the transmission according to the above mentioned aspect.

A method of manufacturing a transmission according to still another aspect of the present invention is a method of manufacturing a transmission that includes a rotary shaft; a transmissive member coupled with the rotary shaft and secured to the rotary shaft, the transmissive member having a first end and a second end; and a regulative member secured to the rotary shaft by press fitting and press-contacts the first end of the transmissive member in such a manner that the transmissive member is perpendicular to the rotary shaft. This method includes finishing a surface of the regulative member, after securing the regulative member to the rotary shaft and before securing the transmissive member to the rotary shaft, in such a manner that the surface press-contacts with the first end of the transmissive member.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention are explained below while referring to the accompanying drawings.

Figure 1:
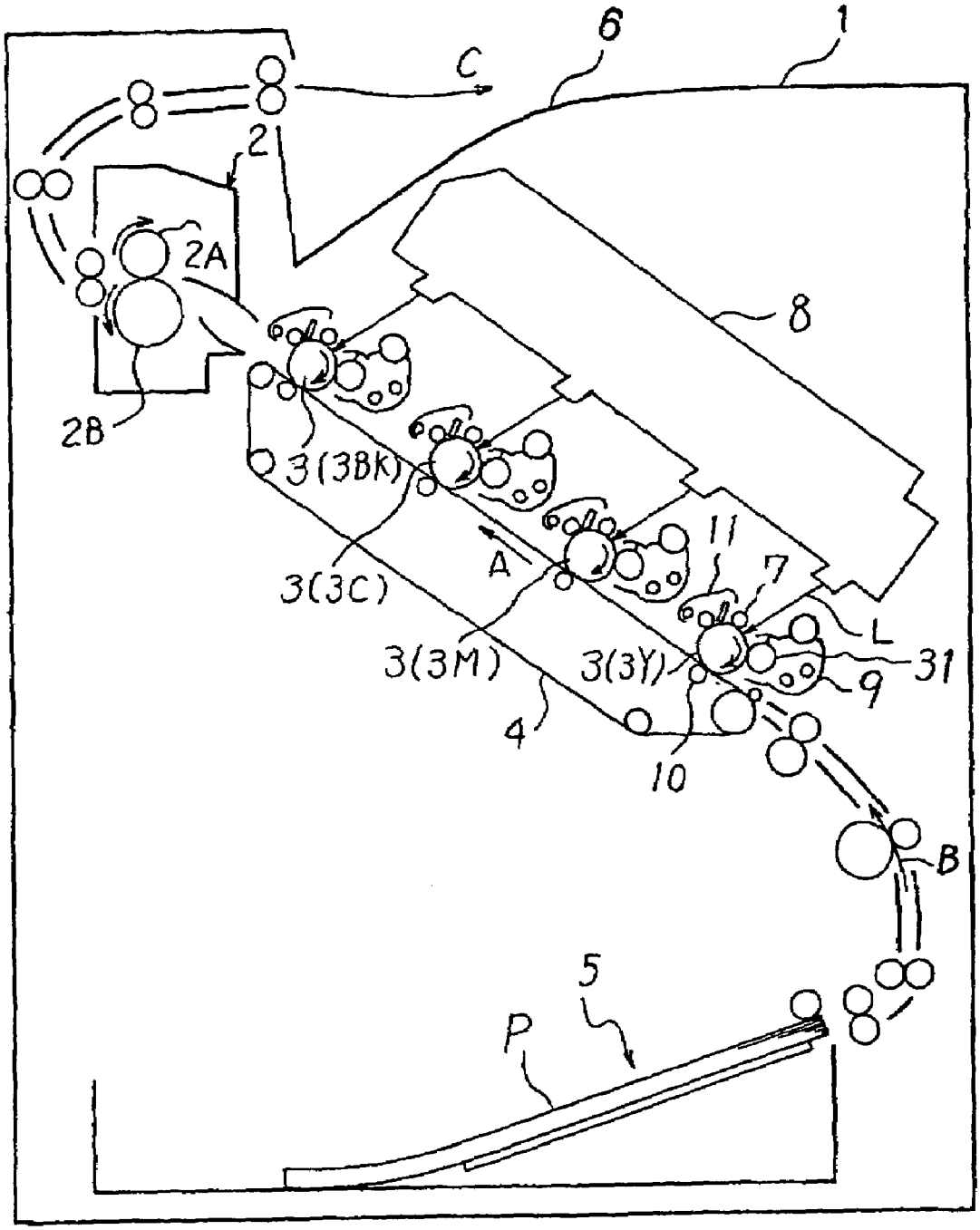
FIG. 1 is a side view of configuration of an image formation apparatus.

FIG. 1 is a side view of configuration of an image formation apparatus. This image formation apparatus is a printer with four photosensitive drums 3 arranged in a body 1. For example, yellow toner image is formed on a first photosensitive drum 3Y, magenta toner image is formed on a second photosensitive drum 3M, cyan toner image is formed on a third photosensitive drum 3C, and black toner image is formed on a fourth photosensitive drum 3BK. A conveyer belt 4 that conveys a recording medium is located below the photosensitive drums 3. The recording medium conveyer belt 4 is suspended around a plurality of support rollers and driven to run in the direction of the arrow A.

The first to the fourth photosensitive drums 3Y, 3M, 3C and 3BK have a substantially similar configuration and perform substantially similar operation when respective toner image is formed thereon. Accordingly, only the configuration and operation of the first photosensitive drum 3Y is explained here. The first photosensitive drum 3Y is rotated in clockwise direction. A charging roller 7 electrically charges the surface of the first photosensitive drum 3Y uniformly to a certain polarity. The surface is then exposed to an optically modulated laser beam L emitted from a laser write unit 8. This results into formation of an electrostatic latent image on the first photosensitive drum 3Y. A developing device 9 sprays yellow toner on the surface. The toner sticks to the charged surface. This results into formation of a yellow tone image. The developing device 9 includes a developing roller 31 that holds the yellow toner.

A paper feed unit 5 feeds a recording medium P, which may be a paper or a resinous film, in the direction of the arrow B to the rotating conveyer belt 4. As a result, the recording medium P passes below the first photosensitive drum 3Y. A transfer roller 10 presses the conveyer belt 4 and the recording medium P against the first photosensitive drum 3Y. As a result, the yellow toner image is transferred onto the recording medium P. A cleaner 11 scrapes off toner remaining on the first photosensitive drum 3Y after the yellow toner image has been transferred onto the recording medium P.

In a similar manner, the toner images of magenta, cyan, and black are transferred onto the recording medium P, in a superimposed manner, above the yellow image. These images are not yet fixed. A fixing unit 2 fixes the images. The fixing unit 2 includes a pair of hot rollers 2A and 2B through which the recording medium with the unfixed images is passed. The temperature and pressure of the rollers 2A and 2B fixes the toner images onto the recording medium P. The recording medium P with the color image printed on it is ejected a tray 6 as shown by the arrow C.

Figure 2:
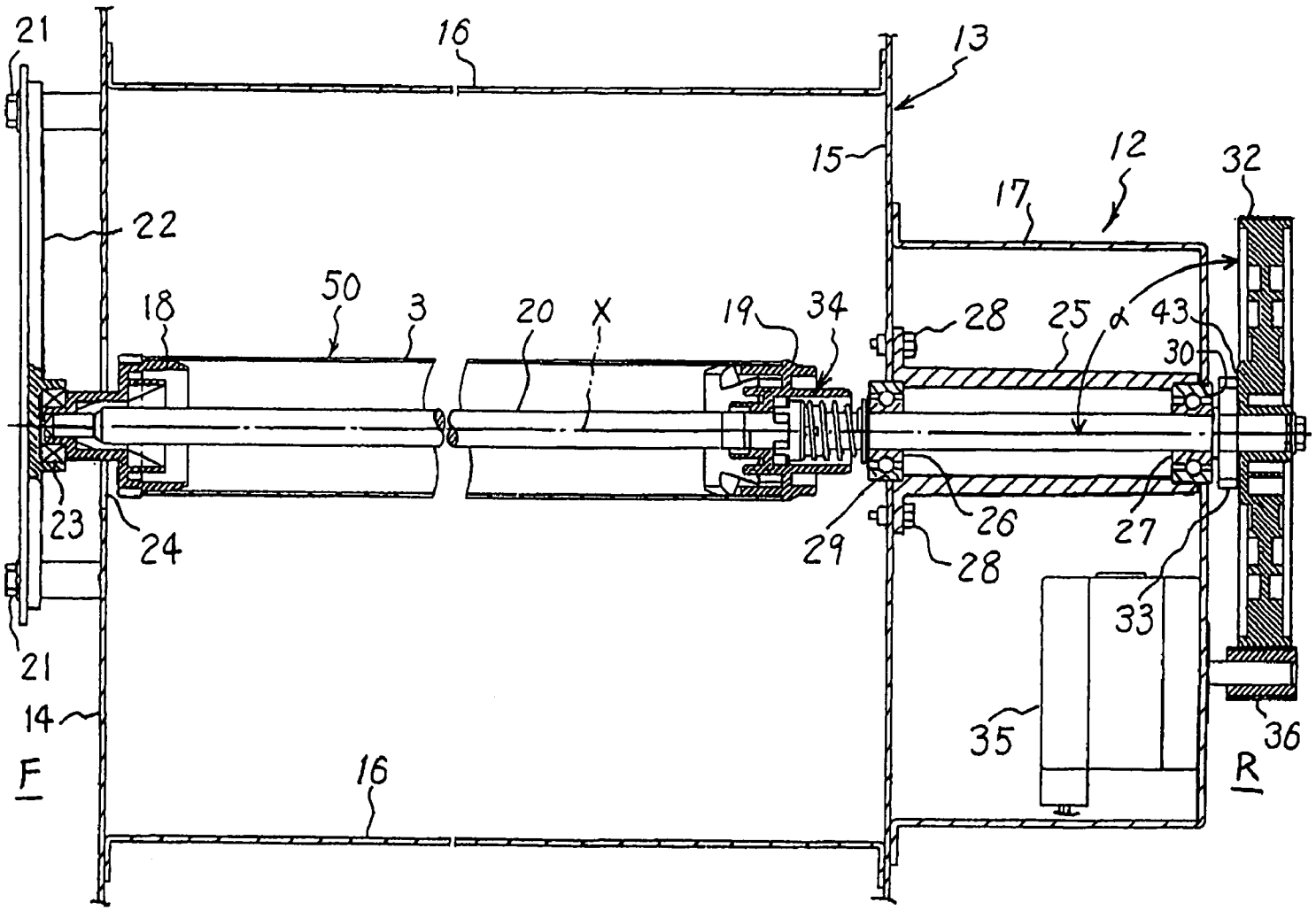
FIG. 2 is a cross-section of a support structure for a photosensitive drum and a transmission configured to transmit its rotation to the photosensitive drum.

Each of the photosensitive drums 3 is supported with a support structure and a transmission conveys a force of a motor to the photosensitive drum 3 to thereby rotate the photosensitive drum 3. FIG. 2 is a cross-section of the support structure and the transmission 12. The reference symbols F and R in FIG. 2 denote two sides.

This configuration includes a body frame 13, which includes a front side plate 14 located towards the F side; a rear side plate 15 located towards the R side; a stay 16 that fixedly links these side plates 14 and 15; and a body bracket 17 secured to the rear side plate 15 with a screw (not shown). A front flange 18 and a rear flange 19 are press-fitted in the photosensitive drum 3 and integrated therewith to configure a drum unit 50. The front flange 18 and the rear flange 19 are detachably secured to the rotary shaft 20 as described later, and configured to allow the rotary shaft 20 to rotate integrally with the drum unit 50.

A positioning member 22 is detachably secured to the front side plate 14 using a plurality of screws 21. The positioning member 22 rotatably supports the front flange 18 via a bearing 23. The front side end of the rotary shaft 20 is detachably fitted with the front flange 18. The front flange 18 and the front side end of the rotary shaft 20 pass through a hole 24 formed through the front side plate 14.

The rear side portion of the rotary shaft 20 extends through the rear side plate 15 and the body bracket 17, and the extended portion is rotatably supported by a pair of rolling bearings 26, 27 held in a cylindrical holder 25. The holder 25 is detachably secured to the rear side plate 15 with a screw 28. Outer rings of the rolling bearings 26, 27 are fitted, without rattling, in holes 29, 30 formed through the rear side plate 15 and the body bracket 17, respectively, to position the rolling bearings 26, 27 and the rotary shaft 20 both relative to the body frame 13. Thus, the rotary shaft 20 is positioned relative to the body frame 13 and rotatably supported, and the photosensitive drum 3 is arranged in coaxial with the rotary shaft 20 via the front flange 18 and the rear flange 19.

The transmission 12 includes the rotary shaft 20 described above; an exemplary transmissive member or gear 32 fitted with the rotary shaft 20 and secured to the rotary shaft 20 as described later; a regulative member 33 detailed later; and a link 34 configured to detachably link the rear flange 19 with the rotary shaft 20. The gear 32 is located at the rear side end of the rotary shaft 20 and arranged in coaxial with the rotary shaft 20.

A drive motor 35 is held on the body flange 17. An output gear 36 is secured around the spindle of the motor and mates with the gear 32. When the drive motor 35 rotates, its rotation is transmitted via the output gear 36 and the gear 32 to the rotary shaft 20, and the rotation of the rotary shaft 20 is transmitted via the link 34 to the rear flange 19, which rotationally drives the drum unit 50 clockwise in FIG. 1.

A transmissive member which consists of a pulley instead of the gear 32 may be secured in coaxial with the rotary shaft 20. The pulley is rotationally driven via a belt to drive the rotary shaft 20 and the photosensitive drum 3.

Figure 3:
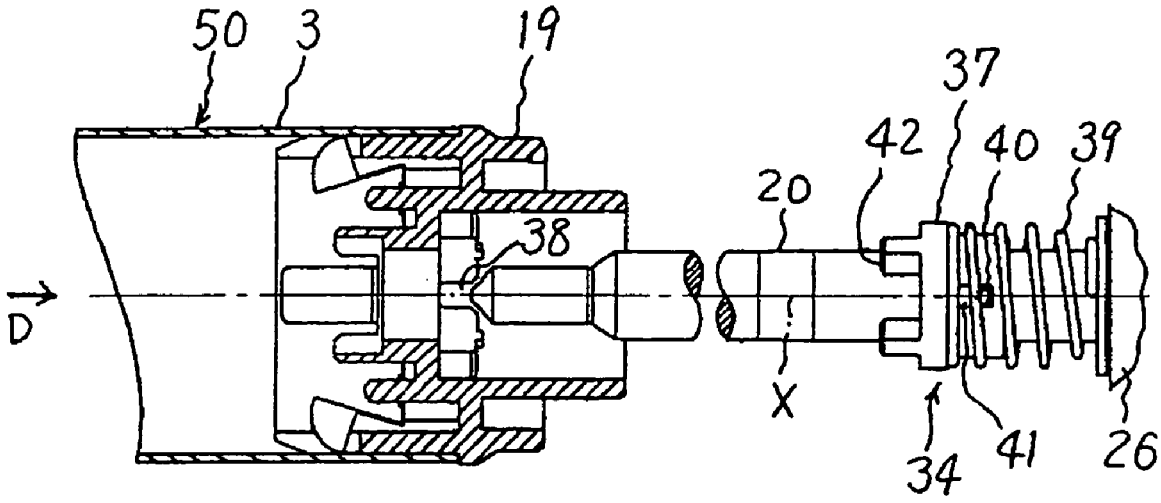
FIG. 3 is a cross-section of a drum unit in a state separated from a rotary shaft.

FIG. 3 is an illustration of the rear flange 19 of the drum unit 50, which is separated from the rotary shaft 20. As shown in FIG. 3, the link 34 includes a hook member 37 fitted with the rotary shaft 20 movably in the axial direction X; plural engagement grooves 38 formed in the rear flange 19 and arranged in annular; and a compressive spring 39 operative to drive the hook member 37 toward the engagement grooves 38. A pin 40 is fixedly attached to the rotary shaft 20. An elliptical hole 41 is formed in the hook member 37. The pin 40 is fitted in the elliptical hole 41 and relatively slidable in the axial direction X of the rotary shaft 20. In a state shown in FIG. 3, the compressive spring presses the hook member 37 to press-contact the pin 40 against one end of the elliptical hole 41. As a result, the hook member 37 is held at the position shown in FIG. 3. As the pin 40 secured on the rotary shaft 20 is fitted in the elliptical hole 41 of the hook member 37, the hook member 37 is prevented from rotating relative to the rotary shaft 20.

When the drum unit 50 is slid as indicated with the arrow D in FIG. 3, the rotary shaft 20 is inserted into the rear flange 19 and the front flange 18 (FIG. 2). Thus, the drum unit 50 is assembled to the body frame 13 as shown in FIG. 2. In this case, the hook member 37 is pressed against the rear flange 19 by the compressive spring 39 to allow plural hooks 42 formed along the circumference of the hook member 37 to fit in the engagement grooves 38 of the rear flange 19. Thus, the drum unit 50 is linked via the hook member 37 with the rotary shaft 20, thereby preventing both from rotating relatively.

As explained above, the drum unit 50 can be attached to and detached from the rotary shaft 20. Therefore, when the positioning member 22 shown in FIG. 2 is removed from the front side plate 14, the drum unit 50 can be drawn forward from the body frame 13. In the reverse operation, the drum unit 50 can be assembled in the body frame 13 and secured to the rotary shaft 20.

After the drum unit 50 is assembled in the body frame 13, when the gear 32 is driven rotationally by the drive motor 35, its rotation is transmitted via the rotary shaft 20 and the rear flange 19 to the photosensitive drum 3, which is thus driven rotationally. The gear 32 has an angle of $\alpha$ to the axis X of the rotary shaft 20, which may largely depart from 90 degrees. In such the case, even though the gear 32 has a constant angular velocity, a constant linear velocity cannot be achieved at the teeth on the outer circumference of the gear 32. As a result, a large velocity variation is found on the gear 32, and a velocity variation is also found on the outer surface of the photosensitive drum 3. When such the velocity variation is intensive, it causes a density variation and color deviation in a toner image held on the recording medium, and deteriorates the quality of the image.

The transmission 12 in the present example is provided with the regulative member 33 as described above. The regulative member 33 is secured on the rotary shaft 20, as shown also in FIG. 4, and press-contacted with an example of the transmissive member, or the gear 32 at one end 43 in the axial direction. The regulative member serves in regulation of the angle of the gear 32 to the rotary shaft 20 such that the end 43 squares the axis X of the rotary shaft 20. The regulative member 33 has a regulative surface 44, which is employed to press-contact the one end 43 of the gear 32. The regulative member 33 is produced such that the regulative surface 44 accurately squares the axis X of the rotary shaft 20. The one end 43 of the gear 32 is press-contacted with the regulative surface 44 to improve the squareness of the gear 32 to the axis X. The regulative member 33 is composed of a material with high stiffness and hardness, preferably a material of sintered metal.

Figure 4:
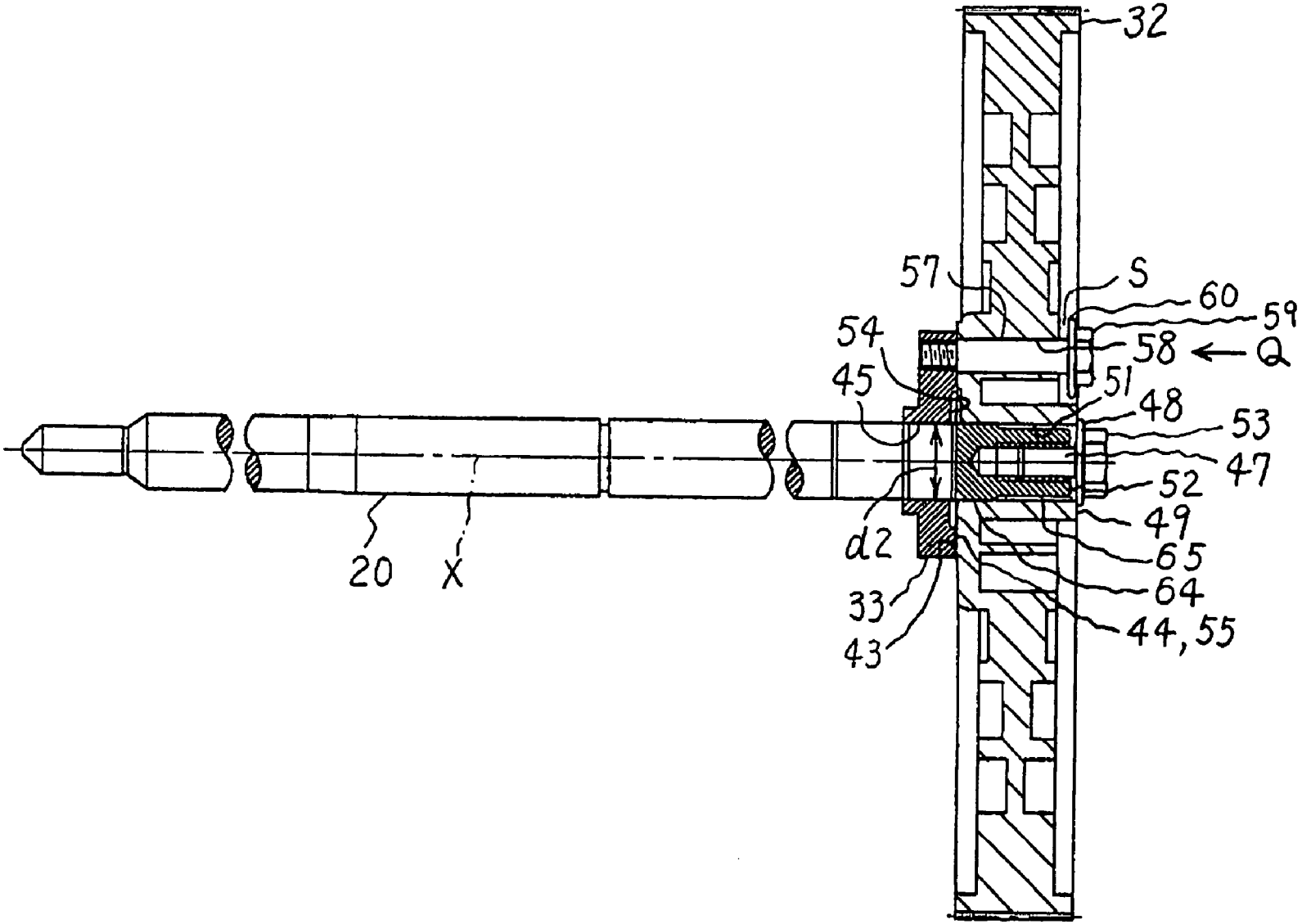
FIG. 4 is cross-section of a regulative member and a gear secured to the rotary shaft.
Figure 5:
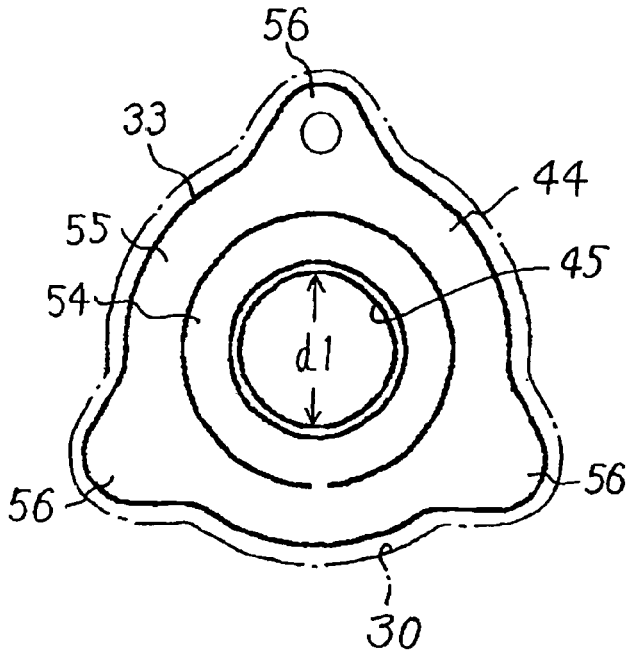
FIG. 5 is a front view of the regulative member when seen from top in FIG. 4.

Conventionally, the regulative member is fit to the rotary shaft with a screw. On the other hand, in the present invention, the regulative member 33 is press-fit to the rotary shaft 20. As shown in FIGS. 4 and 5, the regulative member 33 has a central bore 45 with an inner diameter of d1, and the rotary shaft 20 has an outer diameter of d2 in the portion that fits in the central bore 45. The inner diameter d1 may be set as equal to the outer diameter d2. Alternatively, the outer diameter d2 may be set slightly larger than the inner diameter d1. Then, while applying pressure, the rotary shaft 20 is forcibly fitted in the central bore 45 of the regulative member 33 to combine both for their integration. The secured position of the regulative member 33 in the axial direction X of the rotary shaft 20 is determined by a tool that is used to fit both.

As described above, the regulative member 33 is fixedly press-fitted with the rotary shaft 20, and accordingly no screw is required to secure the regulative member 33. Therefore, it is possible to reject a malfunction associated with non-perpendicularity of the regulative surface 44 to the axis X, which squareness deteriorates when the screw is fastened. Thus, as the gear 32 can be fit exactly perpendicular to the axis X, desired toner image can be obtained.

To surely fit the gear 32 to the axis X at right angle, it is required to press-contact the one end 43 of the gear 32 with the regulative surface 44 of the regulative member 33 as described above. For this purpose in the art, the gear portion located outward in the radial direction from the rotary shaft 20 is secured to the regulative member 33 with a screw to press-contact the one end 43 of the gear 32 with the regulative surface 44 of the regulative member 33. This configuration, however, may deform the gear slightly when the screw is fastened, thereby tilting the gear 32 to the axis X, possibly deteriorating the squareness of the gear 32 to the axis X. In particular, if the gear is composed of a resin, the gear 32 may be deformed locally and the squareness may be deteriorated easily.

In the transmission 12 of the present example, as shown in FIG. 4, a female screw is formed in the central portion on the end of the rotary shaft 20 at the rear side, and a male screw 47 is screwed in the female screw. In this case, a washer 48 for the screw 47 is press-contacted with the end of the gear 32 at the side opposite to the position of the regulative member 33, or the other end 49. The gear 32 has a central bore 51, which fits the rotary shaft 20 movably in the direction of the axis X. The washer 48 is press-contacted near the central bore 51 with the other end portion of the gear 32 thus fitted with the rotary shaft 20. In this case, the secured position of the regulative member 33 is determined such that an end 52 of the rotary shaft 20 at the rear side is located slightly closer to the regulative member 33 than the other end 49 of the gear 32 in the axial direction. Therefore, when the screw 47 is fastened, the washer 48 intensively presses the other end 49 of the gear 32 and press-contacts the end 49. As a result, the gear 32 movably fitted with the rotary shaft 20 is strongly pressed against the regulative member 33, and the one end 43 thereof is strongly press-contacted with the regulative surface 44 of the regulative member 33. Thus, the gear 32 is secured to the regulative member 33, and the gear 32 is secured on the rotary shaft 20. In an alternative configuration, the washer 48 is omitted, and the head 53 of the screw 47 is directly pressed against the other end 49 of the gear 32.

As shown, when the head 53 of the screw 47 screwed in the rotary shaft 20 or the washer 48 for the screw 47 presses the other end 49 of the gear 32, or the exemplary transmissive member, the one end 43 of the transmissive member is press-contacted with the regulative member 33. This is effective to improve the squareness of the gear 32 to the axis X. In addition, the gear 32 and the regulative member 33 are integrated when they are press-fitted with each other. Therefore, the rotation of the gear 32 is transmitted to the regulative member 33, of which rotation is transmitted to the rotary shaft 20 to reliably rotate the rotary shaft 20. The screw 47 is screwed in the central portion of the rotary shaft 20. Therefore, when the screw 47 is fastened intensively to press the screw 47 against the other end 49 of the gear 32, the end 49 may be deformed more or less. Even though, the portion of the end 49 in the vicinity of the central bore 51 uniformly deforms over the whole circumference. Accordingly, even if the gear 32 is resinous, the gear 32 never or rarely tilts to the axis X and can highly retain the squareness of the gear 32 to the axis X.

The regulative surface 44 of the regulative member 33, press-contacting the one end 43 of the gear 32, can be employed as a reference surface to determine the squareness of the gear 32. Accordingly, the regulative surface 44 is required to have a higher smoothness. After the regulative member 33 is processed and produced, a portion of the surface to be the regulative surface 44 is finished to improve the smoothness of the regulative surface. The whole surface of the regulative member 33, which opposes to the one end of the gear 32, may be finished to employ the whole surface as the regulative surface, but this elevates the cost of production.

Preferably, in the surface of the regulative member 33 that opposes to the transmissive member, the one end 43 of the gear 32 in this example, only a part is employed as the regulative surface 44 that press-contacts the one end 43 of the transmissive member. In this case, the other part of the surface of the regulative member 33 is preferably designed as a no contacting surface that never contacts the transmissive member. Specifically, as shown in FIGS. 4 and 5, in the surface of the regulative member 33 that opposes to the one end 43 of the gear 32, a part 54 located near the central bore 45 is recessed deeper than the other part 55 located outward in the radial direction. Only the outer part 55 is finished and employed as the regulative surface 44. The central part 54 is recessed and employed as a no contacting surface that never contacts the end 43 of the gear 32. Thus, in comparison to finishing the whole surface of the regulative member 33 that opposes to the end 43 of the gear 32, the finishing area is reduced, and accordingly the cost for production of the regulative member 33 can be lowered.

As in the example shown in FIGS. 4 and 5, the regulative surface 44 of the regulative member 33 is located outward from the non-contact surface 54 in the radial direction of the regulative member 33. This is effective to further improve the squareness of the gear 32 to the axis X. The regulative surface 44 is little rough, and the angle of the regulative surface 44 to the axis X inevitably departs from the perfect right angle, although the departure is extremely small. If the regulative surface locates near the center of the regulative member 33 in the radial direction and press-contacts a portion near the center in the end of the gear 32, even the small variation of the regulative surface yields enlarged variations that appear on outer locations in the radial direction of the gear 32 and lower the perpendicularity of the gear 32 to the axis X. To the contrary, if the regulative surface 44 locates at a position apart from the center of the regulative member 33 in the radial direction, and a portion near the center in the end of the gear 32 press-contacts the regulative surface 44, even though there is a little variation in the regulative surface 44, the perpendicularity of the gear 32 to the axis X is not lowered greatly.

Thus, by producing the regulative member 33 larger in the radial direction, and press contacting the regulative surface formed in the outer portion in the radial direction with the one end 43 of the gear 32, the gear 32 and the axis X can be positioned at right angles. The regulative member 33 thus produced larger, however, elevates its cost. Further, the shown image formation apparatus is configured to employ the rolling bearings 26, 27 held in the holder 25, during its assembly, to support the rotary shaft 20 with the regulative member 33 secured thereon as shown in FIG. 2. In this state, the holder 25 is secured to the rear side plate 15, then the hole 30 of the body bracket 17 is fitted with the outer ring of the rolling bearing 27 to secure the body bracket 17 to the rear side plate 15, and thereafter the gear 32 is attached to the rotary shaft 20. Therefore, if the regulative member 33 has a larger size in the radial direction, the regulative member 33 cannot pass through the hole 30 of the body bracket 17 when the body bracket 17 is attached. Thus, the body bracket 17 cannot be assembled.

In the transmission 12 of the present example, as shown in FIG. 5, protruded portions 56 are formed at three locations on the outer circumference of the regulative member 33 as protruded outward in the radial direction. The protruded portions 56 are configured as the regulative surface that press-contacts the one end 43 of the gear 32. The protruded portions 56 may be provided more than three. Thus, at least three locations on the outer circumference of the regulative member 33 are formed as the protruded portions 56 that are protruded outward in the radial direction of the regulative member 33 than other portions on the outer circumference of the regulative member 33. In this case, the surfaces of the protruded portions 56, opposing to the one end 43 of the gear 32 that is an example of the transmissive member, are employed as the regulative surface that press-contacts the one end 43 of the transmissive member.

The regulative member 33 catches the gear 32 using the plural protruded portions 56. This is effective to secure the gear 32 in stable. When the protruded portions 56 are provided three, the stability of the gear 32 can be improved particularly. In addition, the protruded portions 56 locate on the outer portion of the regulative member 33 in the radial direction. Accordingly, the gear 32 can be fit to the axis X at perfect right angle. Further, the regulative member 33 has radii, which are not entirely larger over the whole circumference but only larger at the protruded portions 56. Therefore, it is possible to prevent the regulative member 33 from being upsized and suppress the elevation of its cost. In addition, the hole 30 of the body bracket 17 can be made in a form that sets back from the protruded portions 56 of the regulative member 33, as shown in FIG. 5 with the dotted chain line, for example. This form enables the regulative member 33 to pass through the hole 30 without trouble to fit the hole 30 with the outer ring of the rolling bearing 27 when the body bracket 17 is attached.

In the transmission 12 of the present example, as described earlier, the screw 47 is fastened in the rotary shaft 20 to press-contact the one end 43 of the gear 32 with the regulative member 33. Therefore, even only with this configuration, it is possible to secure the gear 32 to the regulative member 33, to transmit the rotation of the gear 32 to the regulative member 33, and to transmit the rotation of the regulative member 33 to the rotary shaft 20. If the screw 47 loosens a little over time, the press-contacting force between the end 43 of the gear 32 and the regulative surface 44 of the regulative member 33 lowers and may cause slight sliding between both possibly. In such the case, the rotation of the gear 32 cannot be transmitted to the rotary shaft 20 correctly.

Preferably, a relative rotation protector is provided to inhibit the transmissive member and the regulative member to rotate relatively. For example, as shown in FIG. 4, a via-hole 58 is formed in the gear 32 that is the example of the transmissive member, and a stepped screw 57 is passed through the via-hole 58 and screwed in the regulative member 33. In this case, the via-hole 58 and the stepped screw 57 configure the relative rotation protector. As the stepped screw 57 inhibits the gear 32 and the regulative member 33 to rotate relatively, the rotation of the gear 32 can be transmitted to the regulative member 33 reliably even though the screw 47 loosens more or less.

As shown in FIG. 4 with the arrow Q, the stepped screw 57 is inserted into the via-hole 58 of the gear 32 from the side of the other end 49 of the gear 32 that is the example of the transmissive member. When the threaded portion of the stepped screw 57 is fastened to the regulative member 33, the stepped screw 57 is secured to the regulative member 33. In this case, the stepped screw 57 is not screwed in the gear 32. In addition, a space S is formed between a head 59 of the stepped screw 57 or its washer 60 and the other end 49 of the gear 32. When the threaded portion of the stepped screw 57 is fastened to the regulative member 33, the head 59 of the stepped screw 57 is not allowed to press the other end 49 of the transmissive member directly or via the washer 60. According to such the configuration, even when the stepped screw 57 is fastened, the gear 32 is not deformed due to the fastening. Therefore, the gear 32 can be fit to the axis X at right angle.

Figure 6:
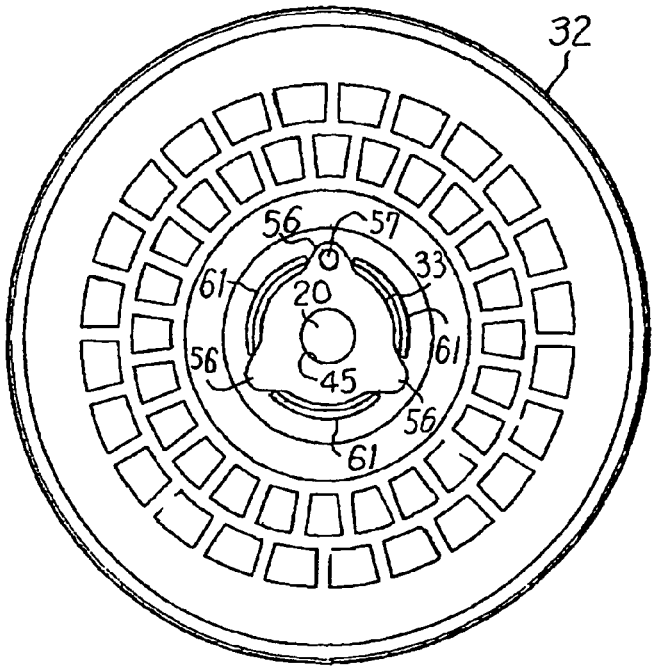
FIG. 6 is a view of the regulative member and the gear when seen from top in FIG. 4.
Figure 7:
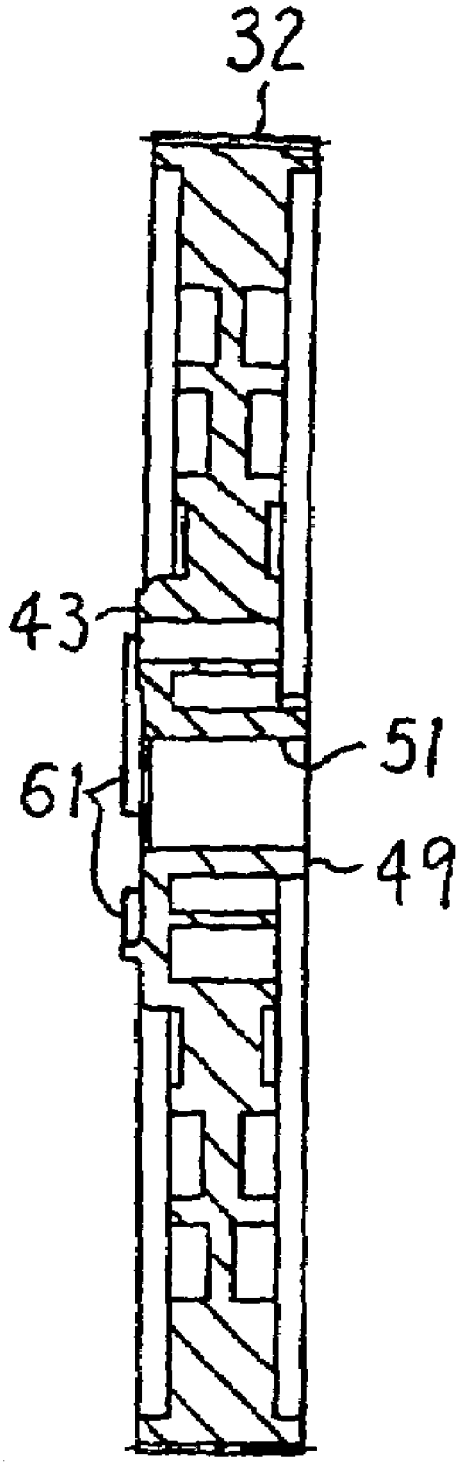
FIG. 7 is a cross-section of the gear.

As shown in FIGS. 6 and 7, plural engagement protrusions 61 may be protruded from the one end 43 of the gear 32. These engagement protrusions 61 are configured to engage the regulative member 33 to transmit the rotation of the gear 32 to the regulative member 33. The engagement protrusions 61 shown in FIGS. 6 and 7 are formed in ribs that extend in annular around the center of the gear 32. The engagement protrusions 61 are provided plural, three in the shown example, and engaged with the protruded portions 56 formed on the regulative member 33, respectively.

The engagement protrusions 61 also form a relative rotation protector, which can transmit the rotation of the gear 32 to the regulative member 33 reliably. When the gear 32 is assembled to the rotary shaft 20, the engagement protrusions 61 formed on the gear 32 are engaged with the protruded portions 56 on the regulative member 33, respectively, to position the gear 32 relative to the regulative member 33.

As described above, the relative rotation protector comprises the engagement protrusions 61, which are formed on the one end 43 of the gear 32 that is an example of the transmissive member, and engaged with the regulative member 33. The engagement protrusions 61 are provided plural. The plural engagement protrusions 61 are arranged in the circumferential direction of the transmissive member. The engagement protrusions 61 are each located between the protruded portions 56 formed on the regulative member 33 and engaged with the protruded portions 56, respectively.

Figure 8:
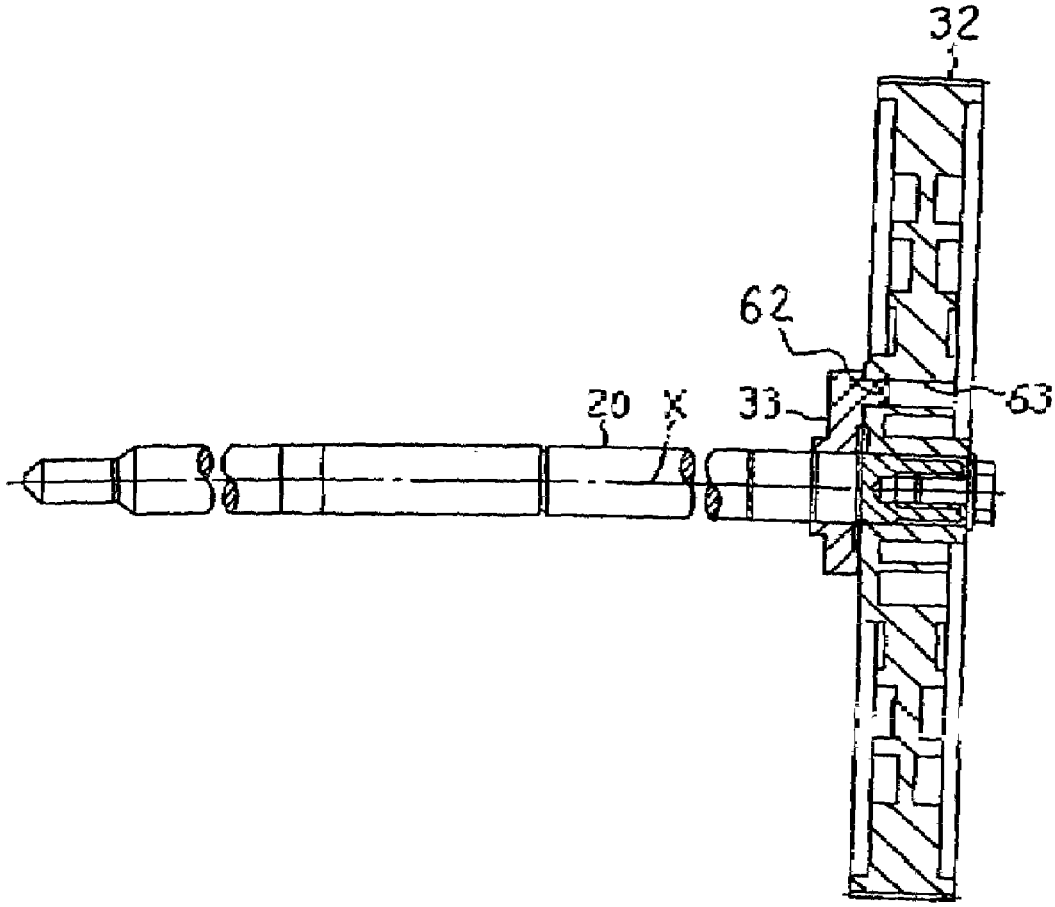
FIG. 8 is a cross-sectional view of another exemplary relative rotation protector.

As shown in FIG. 8, a projection 62 may be formed from the regulative member 33 as projected in the axial direction. The projection 62 is fitted in an engagement hole 63 formed in the gear 32 to transmit the rotation of the gear 32 to the regulative member 33. Thus, a relative rotation protector is configured to include the projection 62 formed from the regulative member 33 and fitted in the engagement hole 63 formed in the transmissive member.

The relative rotation protectors are described above as including the stepped screw 57, the engagement protrusions 61, and the projection 62, respectively. When at least one of these is applied, the rotation of the gear 32 can be transmitted to the rotary shaft 20 reliably even though the screw 47 loosens.

The gear 32 is attached to the rotary shaft 20 when the rotary shaft 20 is fitted in the central bore 51 formed in the gear 32, and the gear 32 is secured to the regulative member 33 using the screw 47. In order to further improve the squareness of the gear to the axis X, it is preferable to configure the whole length in the direction of the axis X on the circumferential surface of the rotary shaft 20 at a portion fitted in the central bore 51 such that the rotary shaft 20 can fit in the central bore 51 without rattling to improve the concentricity of the gear 32 to the rotary shaft 20. Such the configuration, however, results in a difficult fitting work and a lowered workability when the gear 32 is fitted with the rotary shaft 20 because no or little spacing is present between both.

Figure 9:
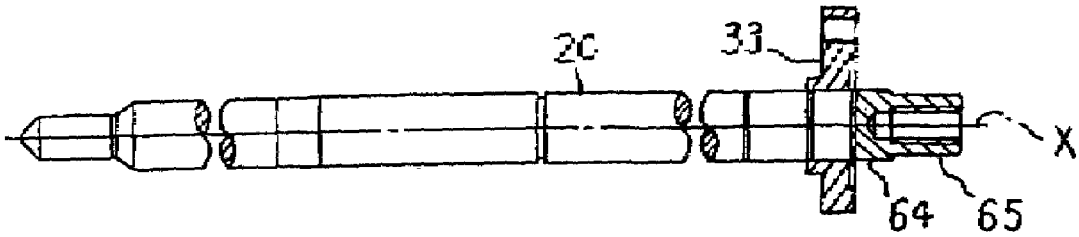
FIG. 9 is a cross-section of the rotary shaft, with the gear removed, shown in FIG. 8.

In the transmission 12 of the present example, as shown in FIGS. 4 and 9, in the outer circumferential surface of the rotary shaft 20 fitted in the central bore 51 of the gear 32, only a portion 64 in the direction of the axis X of the rotary shaft 20 contacts the inner circumferential surface of the central bore of the gear 32 and, with no or little rattling, fits in the bore. The other portion 65 of the rotary shaft is formed to have a smaller diameter than that of the portion 64 of the rotary shaft. The other portion 65 of the rotary shaft is configured not to contact the inner circumferential surface of the central bore of the gear 32. According to this configuration, when only the portion 64 of the rotary shaft 20 is pushed into the central bore 51 relatively, the gear 32 can be attached to the rotary shaft 20, and accordingly the workability can be improved. In addition, the portion 64 of the rotary shaft 20 fits in the central bore 51 with no or little rattling. Therefore, the concentricity of the gear 32 to the rotary shaft 20 is hardly harmed, and the rattling of the gear 32 relative to the rotary shaft 20 can be suppressed.

In the outer circumferential surface of the rotary shaft 20 fitted in the central bore 51 of the gear 32, only the portion 64 near the regulative member 33 contacts the inner circumferential surface of the central bore of the gear 32 and, with no or little rattling, fits in the bore. The other portion 65 of the rotary shaft is formed to have a smaller diameter than that of the portion 64 and is configured not to contact the inner circumferential surface of the central bore. In this case, when the gear 32 is fitted with the rotary shaft 20, the small diameter portion 65 of the rotary shaft is inserted into the central bore 51 of the gear 32 at the beginning of the fitting. Therefore, the gear 32 can be smoothly fitted with the rotary shaft 20 with easy fitting work. It is found from experiments that the gear 32 can be easily fitted with the rotary shaft 20 in particular if the portion 64 of the outer circumferential surface of the rotary shaft 20 has a length of equal to or less than 5 millimeters in the axial direction, which contacts and fits the inner circumferential surface of the central bore of the gear 32.

On production of the regulative member 33, if its surface is subjected to a rust preventing process, the regulative member 33 can be prevented from rusting for a long time period. When the regulative member 33 is finished by cutting or lapping to form the regulative surface 44 of the regulative member 33, which press-contacts the one end 43 of the gear 32 as described above, the process of finishing removes the rust-prevented portion. If this portion is left as such, it may possibly rust. Preferably, the regulative member 33 is composed of a material that causes no rust, for example, stainless steel or aluminum. In particular, the stainless steel is excellent in strength and stiffness, and accordingly it is suitable for the material of the regulative member 33.

After the regulative member 33 is finished to form the regulative surface 44, the regulative member 33 may be fixedly press-fitted around the rotary shaft 20. In this case, even if the processing accuracy of the central bore 45 in the regulative member 33 can be elevated, its slight variation may possibly cause the regulative surface 44 of the regulative member 33 secured on the rotary shaft 20 to have a deteriorated squareness relative to the axis X. Preferably, on production of the transmission 12, after the regulative member 33 is secured on the rotary shaft 20 and before the transmissive member consisting of the gear 32 is attached to the regulative member 33, the regulative member 33 is finished. The finished surface is employed as the regulative surface 44 that is press-contacted with the one end 43 of the gear 32. In such the production of the transmission 12, the squareness of the regulative surface 44 to the axis X of the rotary shaft 20 can be improved even though the regulative member 33 is secured on the rotary shaft 20 with the screw as is in the art. This is because the regulative surface is finished and formed after the regulative member 33 is secured on the rotary shaft 20. Preferably, the regulative member 33 is secured on the rotary shaft 20 by press-fitting also in this case.

The portion 64 of the rotary shaft 20, which fits in the central bore 51 of the gear 32 without rattling, may also be finished to improve the surface accuracy thereof and improve the squareness of the gear 32 to the axis X. Preferably, after the regulative member 33 is secured on the rotary shaft 20 and before the gear 32 is attached to the regulative member 33, a portion of the outer circumferential surface of the rotary shaft 20 is finished also in this case. The finished surface is employed as a regulative surface 64 that contacts and fits the inner circumferential surface of the central bore in the gear 32 with no or little rattling. If the rotary shaft 20 is finished before the gear 32 is attached to the regulative member 33, the finished portion of the rotary shaft suffers damage from the regulative member 33 and lowers its surface accuracy possibly when the regulative member 33 is fitted with the rotary shaft 20. To the contrary, as described above, if the rotary shaft 20 is finished after the regulative member 33 is secured on the rotary shaft 20, such the malfunction can be prevented from arising.

If the regulative member 33 and the rotary shaft 20 are finished at the same time after the regulative member 33 is secured on the rotary shaft 20, the accuracy of the finished surfaces of both can be further improved.

In the processes of finishing, for example, the regulative member 33 is secured on the rotary shaft 20, the rotary shaft 20 is then secured with a tool. Thereafter, the regulative member 33 is finished to form the regulative surface 44 so as to square the axis X of the rotary shaft 20, and similarly the rotary shaft is finished.

In the configuration of the transmission 12 described above, secured to the rotary shaft 20 is the rotator consisting of the photosensitive drum 3 that is rotatable together with the rotary shaft 20, and the rotation of the transmissive member consisting of the gear 32 is transmitted to the rotator. Other rotators, shown in FIG. 1, than the photosensitive drum 3 may be secured to the rotary shaft 20 and driven. They include the transfer roller 10, the developing roller 31, the fixing rollers 2A and 2B, the support roller for supporting the recording medium conveyer belt 4 that conveys a recording medium held thereon, and the recording medium conveyer roller for conveying the recording medium. They also include a support roller, not shown in FIG. 1, for supporting an image carrier belt such as a photosensitive belt and an intermediate transfer belt that holds a toner image transferred from a photosensitive material. In the configuration of the shown example, the rotation of the gear 32 is transmitted to the rotary shaft 20. Such the configuration can be applied to a transmission that transmits the rotation of a rotary shaft to a transmissive member such as a gear.

The present invention is widely applicable to an image formation apparatus consisting of, other than the printer, a copier, a facsimile, a printing machine, or a complex machine thereof, and an image formation apparatus that forms a monochromic image, as well as transmissions in other machines and devices.

According to the present invention, the squareness of the transmissive member to the axis of the rotary shaft can be improved with a simple configuration.

The present document incorporates by reference the entire contents of Japanese priority documents, 2002-268922 filed in Japan on Sep. 13, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A transmission, comprising:

a rotary shaft;

a transmissive member coupled with the rotary shaft and secured to the rotary shaft, the transmissive member having a first end and a second end; and a regulative member secured to the rotary shaft by press fitting, wherein the regulative member press-contacts the first end of the transmissive member in such a manner that the transmissive member is always perpendicular to the rotary shaft, wherein at least three portions in the circumferential direction on the regulative member are protruded outward in the circumferential direction from the regulative member relative to other portions, the protruded portions having surfaces opposing to the first end of the transmissive member, each of the surfaces is formed as a regulative surface that press-contacts the first end of the transmissive member.

2. The transmission according to claim 1, further comprising a screw screwed in the rotary shaft, the screw having a head, the head or a washer for the screw applying pressure to the second end of the transmissive member to press-contact the first end of the transmissive member with the regulative member.

3. The transmission according to claim 1, wherein the regulative member has a surface opposing to the first end of the transmissive member, a part of the surface is formed as a regulative surface that press-contacts the first end of the transmissive member, a part other than the regulative surface of the surface of the regulative member is formed as a no contacting surface that never contacts the transmissive member.

4. The transmission according to claim 3, wherein the regulative surface is located outward in the radial direction from the regulative member relative to the no contacting surface.

5. The transmission according to claim 1, further comprising a relative rotation protector that protects the transmissive member from rotating relative to the regulative member.

6. The transmission according to claim 5, wherein the relative rotation protector comprises a stepped screw that passes through the transmissive member and that is screwed in the regulative member.

7. The transmission according to claim 6, wherein the stepped screw is inserted through the second end of the transmissive member into the transmissive member, the stepped screw having a threaded portion, and the head of the stepped screw is configured not to apply pressure on the second end of the transmissive member directly or via a washer when the threaded portion of the stepped screw is fastened to the regulative member.

8. The transmission according to claim 5, wherein the relative rotation protector comprises engagement protrusions that protrude from the first end of the transmissive member and arranged to engage the regulative member.

9. The transmission according to claim 8, wherein at least three portions in the circumferential direction on the regulative member are protruded outward in the circumferential direction from the regulative member relative to other portions, the protruded portions having surfaces opposing to the first end of the transmissive member, the surfaces each formed as a regulative surface that press contacts the first end of the transmissive member, and the transmissive member further comprises a plurality of engagement protrusions arranged in the circumferential direction of the transmissive member, each engagement protrusion positioned between the protruded portions to engage the protruded portion, respectively.

10. The transmission according to claim 5, wherein the relative rotation protector comprises projections that project from the regulative member and fitted with engagement holes formed in the transmissive member.

11. The transmission according to claim 1, wherein an outer circumference of the rotary shaft fitted with the transmissive member has a portion, in the axial direction of the rotary shaft, that contacts and fits with an inner circumference of a central bore in the transmissive member.

12. The transmission according to claim 1, wherein the outer circumference of the rotary shaft has a portion, located closer to the regulative member, that contacts and fits with the inner circumference of the central bore in the transmissive member.

13. The transmission according to claim 12, wherein the portion of the outer circumference of the rotary shaft that contacts and fits with the inner circumference of the central bore in the transmissive member has a length of equal to or less than 5 millimeters in the axial direction.

14. The transmission according to claim 1, wherein the regulative member is finished to form the regulative surface of the regulative member press contacting with the first end of the transmissive member, the regulative member composed of a stainless steel.

15. The transmission according to claim 1, wherein a rotator is secured around the rotary shaft to rotate integrally with the rotary shaft, rotations of the transmissive member being transmitted to the rotator.

16. The transmission according to claim 15, wherein the rotator comprises any one of a photosensitive drum, a transfer roller, a developing roller, a fixing roller, a recording medium conveyer roller, a support roller for supporting an image carrier belt, and a support roller for supporting a recording medium conveyer belt that conveys a recording medium held thereon.

17. An image formation apparatus comprising a transmission that includes a rotary shaft;

a transmissive member coupled with the rotary shaft and secured to the rotary shaft, the transmissive member having a first end and a second end; and a regulative member secured to the rotary shaft by press fitting, wherein the regulative member press-contacts the first end of the transmissive member in such a manner that the transmissive member is always perpendicular to the rotary shaft, wherein at least three portions in the circumferential direction on the regulative member are protruded outward in the circumferential direction from the regulative member relative to other portions, the protruded portions having surfaces opposing to the first end of the transmissive member, each of the surfaces is formed as a regulative surface that press-contacts the first end of the transmissive member.

18. The image formation apparatus according to claim 17, further comprising a screw screwed in the rotary shaft, the screw having a head, the head or a washer for the screw applying pressure to the second end of the transmissive member to press-contact the first end of the transmissive member with the regulative member.

19. The image formation apparatus according to claim 17, wherein the regulative member has a surface opposing to the first end of the transmissive member, a part of the surface is formed as a regulative surface that press-contacts the first end of the transmissive member, a part other than the regulative surface of the surface of the regulative member is formed as a no contacting surface that never contacts the transmissive member.

20. The image formation apparatus according to claim 19, wherein the regulative surface is located outward in the radial direction from the regulative member relative to the no contacting surface.

21. The image formation apparatus according to claim 17, further comprising a relative rotation protector that protects the transmissive member from rotating relative to the regulative member.

22. The image formation apparatus according to claim 21, wherein the relative rotation protector comprises a stepped screw that passes through the transmissive member and that is screwed in the regulative member.

23. The image formation apparatus according to claim 22, wherein the stepped screw is inserted through the second end of the transmissive member into the transmissive member, the stepped screw having a threaded portion, and the head of the stepped screw is configured not to apply pressure on the second end of the transmissive member directly or via a washer when the threaded portion of the stepped screw is fastened to the regulative member.

24. The image formation apparatus according to claim 21, wherein the relative rotation protector comprises engagement protrusions that protrude from the first end of the transmissive member and arranged to engage the regulative member.

25. The image formation apparatus according to claim 24, wherein at least three portions in the circumferential direction on the regulative member are protruded outward in the circumferential direction from the regulative member relative to other portions, the protruded portions having surfaces opposing to the first end of the transmissive member, the surfaces each formed as a regulative surface that press contacts the first end of the transmissive member, and the transmissive member further comprises a plurality of engagement protrusions arranged in the circumferential direction of the transmissive member, each engagement protrusion positioned between the protruded portions to engage the protruded portion, respectively.

26. The image formation apparatus according to claim 21, wherein the relative rotation protector comprises projections that project from the regulative member and fitted with engagement holes formed in the transmissive member.

27. The image formation apparatus according to claim 17, wherein an outer circumference of the rotary shaft fitted with the transmissive member has a portion, in the axial direction of the rotary shaft, that contacts and fits with an inner circumference of a central bore in the transmissive member.

28. The image formation apparatus according to claim 17, wherein the outer circumference of the rotary shaft has a portion, located closer to the regulative member, that contacts and fits with the inner circumference of the central bore in the transmissive member.

29. The image formation apparatus according to claim 28, wherein the portion of the outer circumference of the rotary shaft that contacts and fits with the inner circumference of the central bore in the transmissive member has a length of equal to or less than 5 millimeters in the axial direction.

30. The image formation apparatus according to claim 17, wherein the regulative member is finished to form the regulative surface of the regulative member press contacting with the first end of the transmissive member, the regulative member composed of a stainless steel.

31. The image formation apparatus according to claim 17, wherein a rotator is secured around the rotary shaft to rotate integrally with the rotary shaft, rotations of the transmissive member being transmitted to the rotator.

32. The image formation apparatus according to claim 31, wherein the rotator comprises any one of a photosensitive drum, a transfer roller, a developing roller, a fixing roller, a recording medium conveyer roller, a support roller for supporting an image carrier belt, and a support roller for supporting a recording medium conveyer belt that conveys a recording medium held thereon.

33. A method of manufacturing a transmission that includes a rotary shaft; a transmissive member coupled with the rotary shaft and secured to the rotary shaft, the transmissive member having a first end and a second end; and a regulative member secured to the rotary shaft by press fitting, wherein the regulative member press-contacts the first end of the transmissive member in such a manner that the transmissive member is always perpendicular to the rotary shaft, wherein at least three portions in the circumferential direction on the regulative member are protruded outward in the circumferential direction from the regulative member relative to other portions, the protruded portions having surfaces opposing to the first end of the transmissive member, each of the surfaces is formed as a regulative surface that press-contacts the first end of the transmissive member, the method comprising:

finishing a surface of the regulative member, after securing the regulative member to the rotary shaft and before securing the transmissive member to the rotary shaft, in such a manner that the surface press-contacts with the first end of the transmissive member.

34. The method according to claim 33, further comprising:

finishing a portion of an outer circumference of the rotary shaft, after securing the regulative member to the rotary shaft and before securing the transmissive member to the rotary shaft, in such a manner that that portion makes a contact with and fits into an inner circumference of a central bore in the transmissive member.

35. The method according to claim 33, wherein the step of securing the regulative member to the rotary shaft includes press fitting the regulative member with the rotary shaft.

* * * * *